US006714116B1

(12) United States Patent
Sang et al.

(10) Patent No.: US 6,714,116 B1
(45) Date of Patent: Mar. 30, 2004

(54) CIRCUIT BREAKER SWITCH

(75) Inventors: Li Chi Sang, Kowloon (HK); Ng Chi Ho, Tsuen Wan (HK)

(73) Assignee: Rototech Electrical Components, Inc., Hicksville, NY (US)

( * ) Notice: Subject to any disclaimer, the term of this patent is extended or adjusted under 35 U.S.C. 154(b) by 0 days.

(21) Appl. No.: 10/054,746

(22) Filed: Jan. 22, 2002

(51) Int. Cl.[7] ..... H01H 37/52

(52) U.S. Cl. ..... 337/68; 337/37; 337/36; 337/56; 337/66; 337/91; 200/339; 200/341; 200/553

(58) Field of Search ..... 337/37, 36, 53, 337/56, 59, 66, 68, 79, 85, 91; 200/401, 402, 412, 417, 422, 508, 510, 520, 553, 339, 341

(56) References Cited

U.S. PATENT DOCUMENTS

| | | | | | |
|---|---|---|---|---|---|
| 2,362,850 | A | | 11/1944 | Platz | 200/116 |
| 2,636,958 | A | | 4/1953 | Dorfman et al. | |
| 2,911,503 | A | | 11/1959 | Garbers | 200/122 |
| 3,617,971 | A | | 11/1971 | Ellenberger | 337/66 |
| 3,629,764 | A | | 12/1971 | Frey et al. | 337/91 |
| 4,048,607 | A | | 9/1977 | Smorzaniuk | 337/53 |
| 4,068,203 | A | * | 1/1978 | Unger | 337/56 |
| 4,123,737 | A | * | 10/1978 | Hoagland, Jr. | 337/68 |
| 4,258,349 | A | | 3/1981 | Flory | 337/46 |
| 4,345,233 | A | | 8/1982 | Matthies | 337/75 |
| 4,363,016 | A | | 12/1982 | Unger | 337/56 |
| 4,379,278 | A | * | 4/1983 | Kuczynski et al. | 337/91 |
| 4,510,479 | A | | 4/1985 | Merchant | 337/91 |
| 4,528,538 | A | * | 7/1985 | Andersen | 337/43 |
| 4,570,142 | A | | 2/1986 | Ineichen et al. | 337/66 |
| 4,814,739 | A | * | 3/1989 | Moldovan | 337/68 |
| 4,833,439 | A | * | 5/1989 | Bowden et al. | 337/68 |
| 4,862,131 | A | | 8/1989 | Oster et al. | 337/48 |
| 4,868,535 | A | * | 9/1989 | Janniere et al. | 337/68 |
| 4,922,219 | A | | 5/1990 | Bakhaus et al. | 337/74 |
| 4,931,762 | A | | 6/1990 | Fierro | 337/66 |
| 4,937,548 | A | | 6/1990 | Sdunek | 337/70 |
| 5,004,994 | A | | 4/1991 | Korczynski et al. | 337/66 |
| 5,021,761 | A | | 6/1991 | Stack et al. | 337/68 |
| 5,089,799 | A | | 2/1992 | Sorenson | 337/68 |
| 5,101,186 | A | | 3/1992 | Durum | 337/76 |
| 5,223,813 | A | | 6/1993 | Cambreleng et al. | 337/66 |
| 5,453,725 | A | | 9/1995 | You et al. | 337/68 |
| 5,491,460 | A | | 2/1996 | Krasser et al. | 337/70 |
| 5,519,561 | A | | 5/1996 | Mrenna et al. | 361/105 |
| 5,539,371 | A | | 7/1996 | Yu | 337/66 |
| 5,541,569 | A | | 7/1996 | Jang | 337/68 |
| 5,694,106 | A | | 12/1997 | Wang | 337/79 |
| 5,742,219 | A | * | 4/1998 | Moalem et al. | 337/68 |
| 5,783,986 | A | | 7/1998 | Huang | 337/348 |
| 5,786,742 | A | | 7/1998 | Yin | 337/66 |
| 5,828,284 | A | | 10/1998 | Huang | 337/37 |
| 5,847,638 | A | | 12/1998 | Sorenson | 337/380 |
| 5,889,457 | A | | 3/1999 | Hsu et al. | 337/59 |
| 5,892,426 | A | | 4/1999 | Huang | 337/59 |
| 5,898,355 | A | | 4/1999 | Yu | 337/8 |
| 5,918,361 | A | * | 7/1999 | Moalem et al. | 29/622 |
| 5,936,505 | A | * | 8/1999 | Yu | 337/66 |
| 6,377,158 | B1 | * | 4/2002 | Yu | 337/37 |

* cited by examiner

*Primary Examiner*—Anatoly Vortman
(74) *Attorney, Agent, or Firm*—Gauthier & Connors LLP

(57) ABSTRACT

A circuit breaker switch is disclosed, including a rocker, an actuator, and a dielectric separator element. The rocker is positionable between a first on position and a second off position. The actuator element is coupled to the rocker such that it causes a first electrically conductive contact portion to move into contact with a second electrically conductive contact portion when the rocker is in the on position. The dielectric separator element is urged between the first and second electrically conductive contact portions in the event of excess current being passed between the first and second electrically conductive contact portions.

14 Claims, 4 Drawing Sheets

CIRCUIT BREAKER SWITCH

The invention generally relates to the field of circuit breakers, and particularly relates to the field of re-settable circuit breaker switches that may be economically and efficiently produced.

BACKGROUND OF THE INVENTION

Circuit breaker switches generally include a reactive element (for example a bimetallic conductive material) that is in the path of the current passing through the breaker when the switch is in the on position. The reactive element responds to an excess current or voltage charge by changing a property of the reactive element such as its shape, and thereby disrupting the path of the current through the breaker.

For example, U.S. Pat. No. 5,491,460 discloses a switch that includes a thermal triggering element that cooperates with other portions of the circuit in providing overcurrent protection, and U.S. Pat. Nos. 5,847,638; and 5,892,426 disclose switches that specifically include a bimetallic element that changes shape to provide circuit protection against excess current. Further, U.S. Pat. No. 5,539,371 discloses a circuit breaking switch that includes an alloy blade 170 that changes its curvature responsive an current overload condition.

Convention circuit breaker switches, however, typically require numerous small parts that must be assembled accurately, and sometimes require minor adjustments via set screws etc. to function optimally. For example, the breaking switch disclosed in U.S. Pat. No. 5,539,371 includes an adjusting screw that may be rotated to adjust the arch of a spring blade.

There is a need for a circuit breaker switch that is relatively inexpensive to produce yet operates efficiently.

There is further a need for a circuit breaker switch that provides an indication that the breaker has tripped.

There is further a need for a c circuit breaker switch that may be easily re-set.

SUMMARY OF THE INVENTION

A circuit breaker switch is disclosed, including a rocker, an actuator, and a dielectric separator element. The rocker is positionable between a first on position and a second off position. The actuator element is coupled to the rocker such that it causes a first electrically conductive contact portion to move into contact with a second electrically conductive contact portion when the rocker is in the on position. The dielectric separator element is urged between the first and second electrically conductive contact portions in the event of excess current being passed between the first and second electrically conductive contact portions.

In various embodiments, the switch further includes a trip indicator that is coupled to the dielectric separator element such that the trip indicator provides a visual indication that excess current has been passed between the first and second electrically conductive contact portions. In further embodiments, the switch may be reset by depressing the trip indicator.

BRIEF DESCRIPTION OF THE DRAWINGS

The following detailed description of the illustrated embodiments may be further understood with reference to the accompanying drawings in which.

The drawings are for illustrative purposes only and are not to scale.

DETAILED DESCRIPTION OF THE ILLUSTRATED EMBODIMENTS

Figure 1:
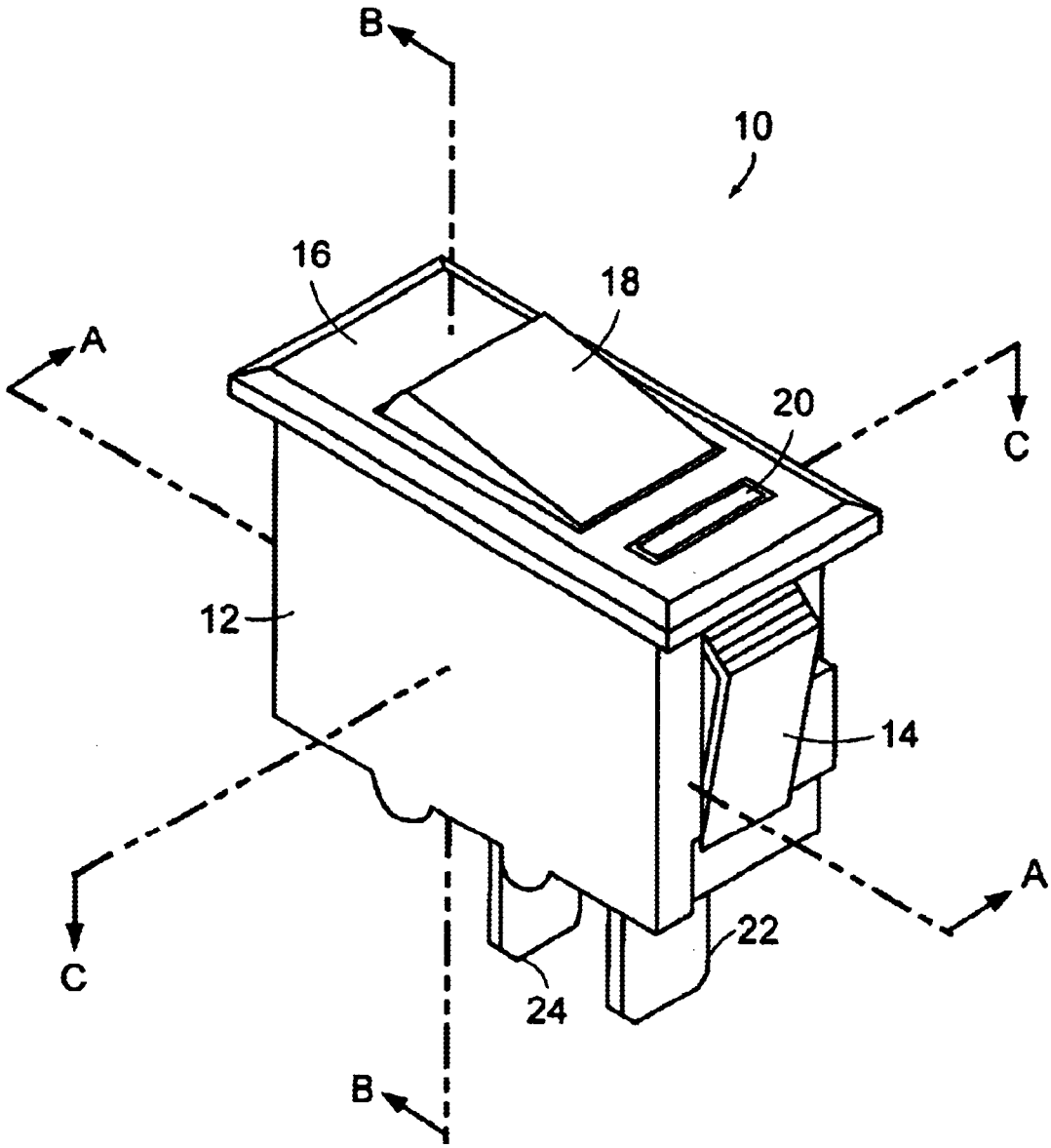
FIG. 1 shows an illustrative isometric view of a circuit breaker switch of the invention.

As shown in FIG. 1, a circuit breaker switch 10 in accordance with an embodiment of the invention includes a housing 12 that includes a pair of resilient retainer portions 14 for mounting the circuit breaker switch 10 and a top portion 16. The circuit breaker switch lo also includes an ON/OFF rocker 18 and a trip indicator 20 that are exposed through openings in the top portion 16 of the housing 12.

Figure 2A:
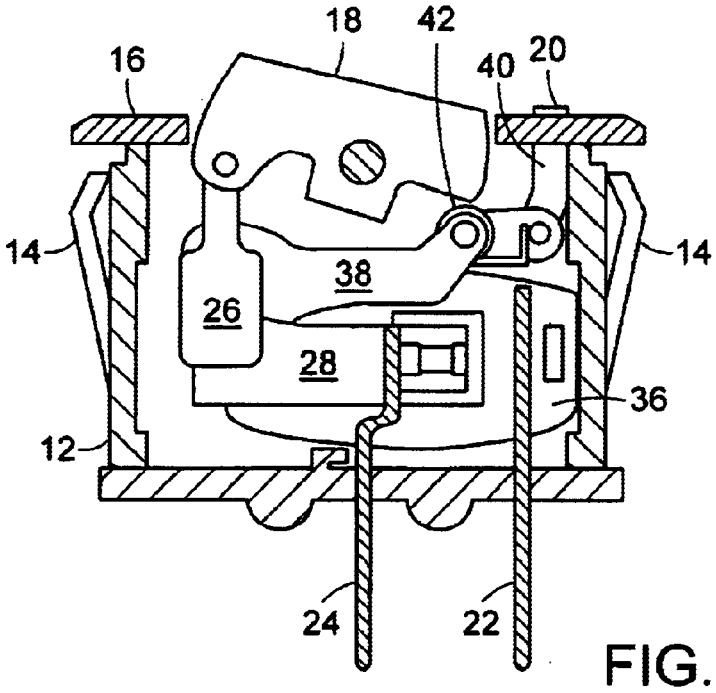
FIG. 2A shows an illustrative side sectional view of the circuit breaker switch shown in FIG. 1 in the off position taken along line A—A thereof.
Figure 2B:
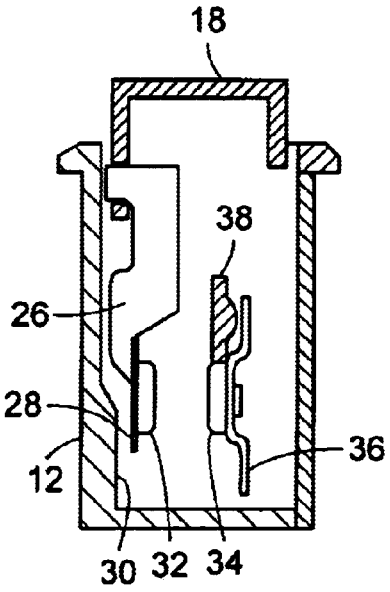
FIG. 2B shows an illustrative end sectional view of the circuit breaker switch shown in FIG. 1 in the off position taken along line B—B thereof.
Figure 2C:
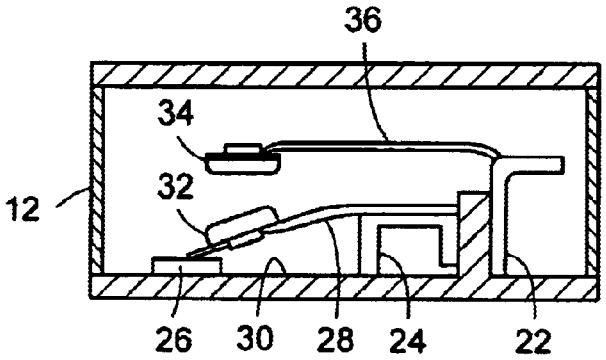
FIG. 2C shows an illustrative bottom sectional view of the circuit breaker switch shown in FIG. 1 in the off position taken along line C—C thereof.

Generally, during use an electrically conductive path may be established between a line terminal 22 and a load terminal 24 by positioning the ON/OFF rocker 18 to the ON position. If the circuit breaker switch 10 is overloaded and trips, then the trip indicator 20 will protrude through the top portion 16 of the housing 12. The switch 10 may then be reset by depressing the trip indicator 20 as discussed below in further detail. FIGS. 2A–2C show the switch 10 in the OFF position, FIGS. 3A–3C show the switch 10 in the ON position, and FIGS. 4A–4C show the switch 10 in the trip position.

Figure 3A:
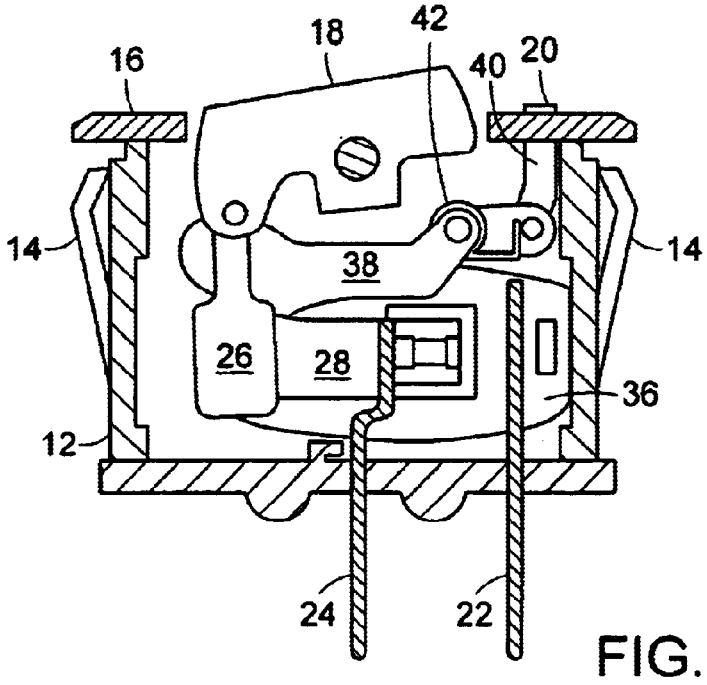
FIG. 3A shows an illustrative side sectional view of the circuit breaker switch shown in FIG. 1 in the on position taken along line A—A thereof.
Figure 3B:
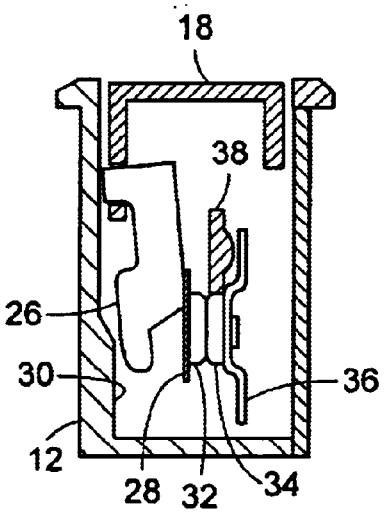
FIG. 3B shows an illustrative end sectional view of the circuit breaker switch shown in FIG. 1 in the on position taken along line B—B thereof.
Figure 3C:
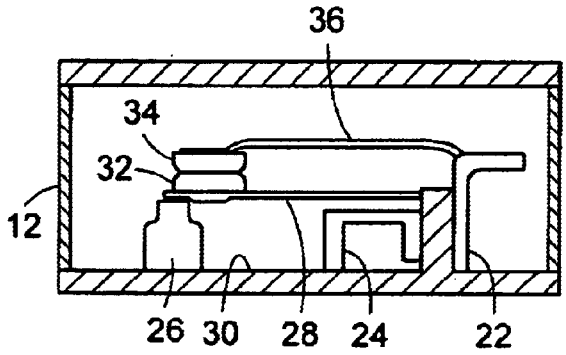
FIG. 3C shows an illustrative bottom sectional view of the circuit breaker switch shown in FIG. 1 in the on position taken along line C—C thereof.

As shown in FIG. 2A, the rocker 18 is pivotally coupled to an actuator block 26 such that as the rocker 18 is moved from the OFF position (as shown in FIG. 2A) to the ON position (as shown in FIG. 3A), the lower portion of the block 26 is wedged between the adjacent inner wall 30 of the housing 12 and a spring plate 28. As shown in FIG. 2B, the spring plate 28 includes a first electrically conductive contact element 32, and as the block 26 is wedged between the inner wall 30 of the housing 12 and the spring plate 28, the contact element 32 is urged to move against a second electrically conductive contact element 34 as shown in FIG. 3B. The second contact element 34 is mounted on a bimetallic strip 36 that is electrically coupled to the line terminal 22 as shown in FIG. 2C. The spring plate 28 is electrically coupled to the load terminal 24 as shown in FIG. 2C, and when the first and second contact elements 32 and 34 are in contact with one another as shown in FIGS. 3A–3C, electrical conductivity is established between the line terminal 22 and the load terminal 24.

The switch 10 also includes a rotating dielectric lever 38 that is pivotally coupled to an indicator lever 40, the top of which includes the indicator 20. The switch 10 also includes bias spring 42 that urges the lower portion of the lever 38 against the second contact element 34 as shown in FIGS. 2B and 3B. If the breaker switch 10 is overcharged, the bimetallic strip 36 bends responsive to the excess current causing the second contact element 34 to be drawn away from the first contact element 32 as shown in FIG. 4C. The lower portion of the lever 38 is then urged between the contacts 32 and 34 as shown in FIGS. 4B and 4C ensuring that the elements 32 and 34 are not in electrical contact with one another.

Figure 4A:
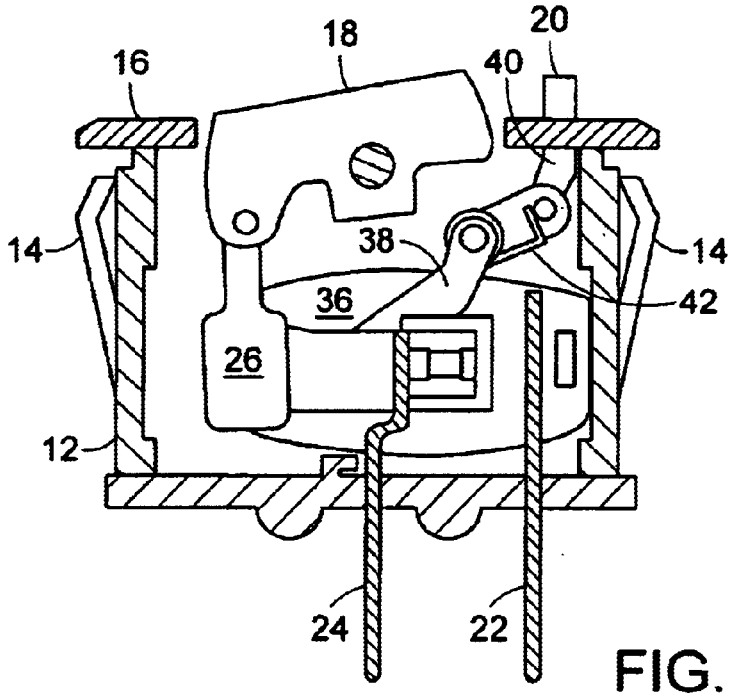
FIG. 4A shows an illustrative side sectional view of the circuit breaker switch shown in FIG. 1 in the trip position taken along line A—A thereof.
Figure 4B:
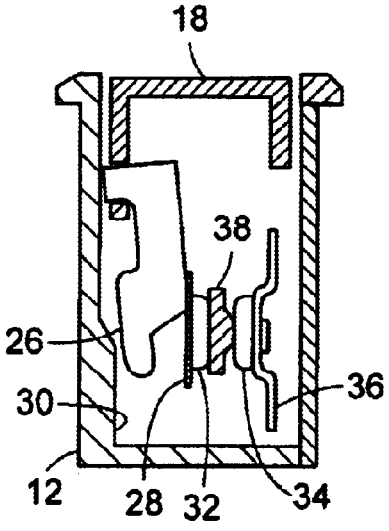
FIG. 4B shows an illustrative end sectional view of the circuit breaker switch shown in FIG. 1 in the trip position taken along line B—B thereof.
Figure 4C:
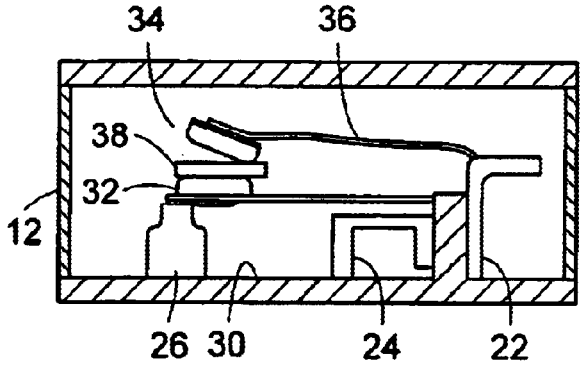
FIG. 4C shows an illustrative bottom sectional view of the circuit breaker switch shown in FIG. 1 in the trip position taken along line C—C thereof.

As shown in FIG. 4A, the rotation of the dielectric lever 38 causes the indicator lever 40 to move upward through the top portion 167 of the housing 12. The indicator 20 is included in the top of the lever 40 and provides a visual indication that the breaker has tripped. The switch 10 may then be turned off by moving the rocker to the OFF position as shown in FIG. 2A, and the switch may be reset by depressing the indicator 20 back into the top portion 16 of the housing 12. This will cause the dielectric lever to return to the position shown in FIGS. 2B, 2C, 3B and 3C.

Circuit breaker switches such as that disclosed above may be efficiently and economically produced due to the relatively few number of parts required. Those skilled in the art will appreciate that modifications and variations may be made to the above disclosed embodiments without departing from the spirit and scope of the invention.

What is claimed is:

1. A circuit breaker switch comprising:

a rocker that is positionable between a first on position, and a second off position;

an actuator element that is coupled to the rocker such that it causes a first electrically conductive contact portion to move into contact with a second electrically conductive contact portion when said rocker is in the on position; and a dielectric separator element that is urged between the first and second electrically conductive contact portions in the event of excess current being passed between the first and second electrically conductive contact portions at least in part, by a bimetallic element that urges the second electrically conductive contact portion to move away form the first elastically conductive contact portion.

2. The circuit breaker switch as claimed in claim 1, wherein said switch further comprises a trip indicator that is coupled to said dielectric separator element such that said trip indicator provides a visual indication that said dielectric separator element has moved in the event of excess current being passed between the first and second electrically conductive contact portions.

3. The circuit breaker switch as claimed in claim 2, wherein said switch may be reset by depressing said trip indicator.

4. The circuit breaker switch as claimed in claim 1, wherein said actuator element causes the first electrically conductive contact portion to move into contact with the second electrically conductive portion by being forced between the fir&t electrically conductive contact portion and an inner wall of a switch housing.

5. A circuit breaker switch as claimed in claim 1, wherein said dielectric separator element is urged between the first and second electrically conductive contact portions, at least in part, by a bias spring that urges said dielectric separator element against the second electrically conductive contact portion.

6. A circuit breaker switch comprising:

a rocker that is positionable between a first off position, and a second on position;

an actuator element that is coupled to the rocker such that it causes a first electrically conductive contact portion to move in a first direction into contact with a second electrically conductive contact portion when said rocker is in the on position, said second electrically conductive contact portion being mounted on a bimetallic element and said second electrically conductive portion being movable away from said first electrically conductive portion in said first direction in the event of excess current being passed through said bimetallic element; and a dielectric separator clement that is urged between the first and second electrically conductive contact portions in the event of excess current being passed through said bimetallic element.

7. The circuit breaker switch as claimed in claim 6, wherein said switch further comprises a trip indicator that is coupled to said dielectric separator element such, that said trip indicator provides a visual indication that said dielectric separator element has moved in the event of excess current being passed through said bimetallic element.

8. A circuit breaker switch as claimed in claim 6, wherein said dielectric separator element is urged between the first and second electrically conductive contact portions, at leas in part, by a bias spring that urges said dielectric separator element against the second electrically conductive contact portion.

9. The circuit breaker switch as claimed in claim 6, wherein said switch further comprises a trip indicator that is coupled to said dielectric separator element such that said trip indicator provides a visual indication that said dielectric separator element has moved in the event of excess current being passed between the first and second electrically conductive contact portions.

10. The circuit breaker switch as claimed in claim 9, wherein said switch may be reset by depressing said trip indicator.

11. The circuit breaker switch as claimed in claim 6, wherein said actuator element causes the first electrically conductive contact portion to move into contact with the second electrically conductive portion by being forced between the first electrically conductive contact portion and an inner wall of a switch housing.

12. A circuit breaker switch as claimed in claim 6, wherein said dielectric separator element is urged between the first and second electrically conductive contact portions, at least in part, by said bimetallic element which urges the second electrically conductive contact portion to move away from the first electrically conductive contact portion in the event of excess current being passed between the fist and second electrically conductive contact portions.

13. A circuit breaker switch as claimed in claim 6, wherein said dielectric separator element is urged between the first and second electrically conductive contact portions, at least in part by a bias spring that urges said dielectric separator element against the second electrically conductive contact portion.

14. A method of using a circuit breaker switch, said method comprising the steps of:

positioning a rocker to a first on position, causing a first electrically conductive portion to move in a first direction into contact with a second electrically conductive portion;

overcharging said switch causing said second electrically conductive portion to move away from said first electrically conductive portion in said first direction;

providing a dielectric insulator element to be positioned between said first and second electrically conductive portions; and providing it visual indication that the circuit breaker switch has been tripped.

* * * * *